US009042749B2

(12) United States Patent
Yabuki

(10) Patent No.: US 9,042,749 B2
(45) Date of Patent: May 26, 2015

(54) FIXING DEVICE INCLUDING HEATING BODY AND OVERTEMPERATURE PROTECTOR, IMAGE FORMING APPARATUS AND FIXING DEVICE HEATING UNIT THEREWITH

(71) Applicant: Oki Data Corporation, Tokyo (JP)

(72) Inventor: Ryoji Yabuki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 216 days.

(21) Appl. No.: 13/628,680

(22) Filed: Sep. 27, 2012

(65) Prior Publication Data

US 2013/0078018 A1 Mar. 28, 2013

(30) Foreign Application Priority Data

Sep. 28, 2011 (JP) ..... 2011-213544

(51) Int. Cl.
*G03G 15/20* (2006.01)

(52) U.S. Cl.
CPC .... *G03G 15/2017* (2013.01); *G03G 2215/2035* (2013.01)

(58) Field of Classification Search
CPC ..... G03G 15/2039; G03G 15/2078; G03G 15/205; G03G 2215/2022; G03G 2215/2035
USPC ..... 399/33, 329
See application file for complete search history.

(56) References Cited

U.S. PATENT DOCUMENTS 6,075,228 A * 6/2000 Goto et al. ..... 399/329
8,412,084 B2 * 4/2013 Ishida et al. ..... 399/329

FOREIGN PATENT DOCUMENTS

JP 07-199701 A 8/1995
JP 2004-191514 A 7/2004
JP 2007-322888 A 12/2007

* cited by examiner

*Primary Examiner* — William J Royer
(74) *Attorney, Agent, or Firm* — Muncy, Geissler, Olds & Lowe, P.C.

(57) ABSTRACT

A fixing device includes an endless belt that supplies heat to a medium, a heat diffusion member that stretches the endless belt, a heating body that heats the heat diffusion member, an overtemperature protector that is positioned to face the heating body; and a pressure application support member that is positioned between the heating body and the overtemperature protector.

16 Claims, 17 Drawing Sheets

FIXING DEVICE INCLUDING HEATING BODY AND OVERTEMPERATURE PROTECTOR, IMAGE FORMING APPARATUS AND FIXING DEVICE HEATING UNIT THEREWITH

CROSS REFERENCE TO RELATED APPLICATION

The present application is related to, claims priority from and incorporates by reference Japanese Patent Application No. 2011-213544, filed on Sep. 28, 2011.

TECHNICAL FIELD

This invention relates to a fixing device that fixes a toner image transferred on a medium onto the medium by heat and pressure, and an image forming apparatus that includes such a fixing device, and a fixing device heating unit that uses some components of the fixing device.

BACKGROUND

Electrographic printers, photocopy machines, facsimile machines and the like are examples of an image forming apparatus that transfers a black-and-white or color toner image formed on a toner image forming part onto a medium, such as a sheet and the like. Such an image forming apparatus includes a fixing device. Conventionally, this type of fixing device includes a movable endless fixing belt, a sheet heating body that heats the fixing belt, a fixing roller that stretches the fixing belt with the sheet heating body, a pressure application roller provided to face the fixing roller via the fixing belt, and a nip part formed at a contact part of the pressure application roller and the fixing belt. The toner image is fixed on the medium by feeding the medium on which the toner image has been transferred to and passing through the nip part and by applying heat from the sheet heating body and pressure by the fixing roller and the pressure application roller at the time of passage (see Japanese Laid-Open Patent Application No. 2007-322888).

However, the above-described conventional technology does not consider a case in which an overtemperature protector is used for protecting the sheet heating body from overtemperature. One of objects of the present invention is to solve such a problem.

SUMMARY

Considering the objections, a fixing device of the invention includes an endless belt that supplies heat to a medium, a heat diffusion member that stretches the endless belt, a heating body that heats the heat diffusion member, an overtemperature protector that is positioned to face the heating body; and a pressure application support member that is positioned between the heating body and the overtemperature protector.

With such a structure, the fixing device reduces a chance that the temperature of an overtemperature protector unnecessarily increases, by providing a pressure application support member between a heating body and an overtemperature protector.

In another view of the invention, a fixing device heating unit includes a heat diffusion member that diffuses heat including a two-step indented part, the two-step indented part including a first indented section and a second indented section larger than the first indented section, a heating body that heats the heat diffusion member and that has a first width, the heating body being fitted in the first indented section and including a first side facing the heat diffusion member and a resistance heating body being provided on the first side, a pressure application support member that contacts the heating body and has a second width larger than the first width, the pressure application support member being fitted in the second indented section, and heat transfer from the heating body to the heat diffusion member is faster than from the heating body to the pressure application support member.

DETAILED DESCRIPTION OF EMBODIMENTS

Embodiments of a fixing device of an image forming apparatus according to the present invention are explained below with reference to figures.

First Embodiment

Figure 1:
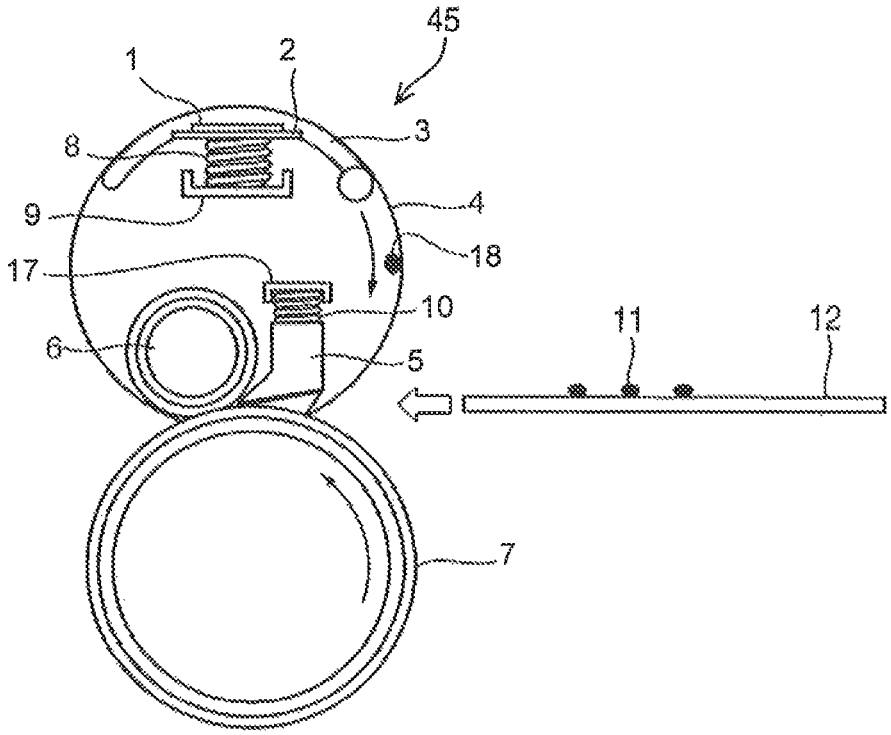
FIG. 1 is a side view of a configuration of a first embodiment.
Figure 2:
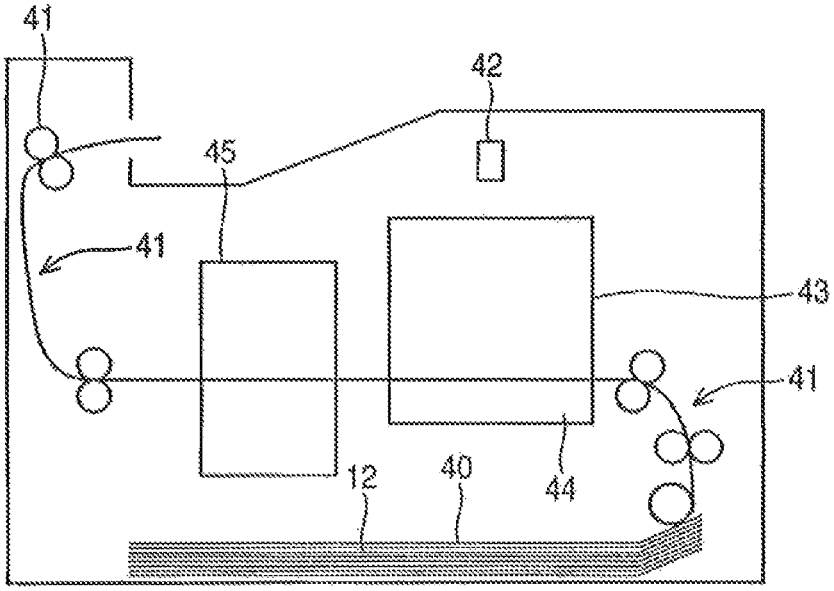
FIG. 2 is a schematic side view of an image forming apparatus that includes the first embodiment.

FIG. 1 is a side view of a configuration of a first embodiment. FIG. 2 is a schematic side view of an image forming apparatus that includes the first embodiment. First, a configuration shown in FIG. 2 is explained. The image forming apparatus of the present embodiment is an electrographic printer that includes a sheet accommodation part 40 that accommodates sheets 12 as media, a sheet carrying part 41 configured from a plurality of carrying rollers and the like that carry each sheet 12 fed from the sheet accommodation part 40, a light emitting diode (LED) head 42 as an exposure part that emits recording light for exposure, a toner image forming part 43 that forms a toner image in response to the light emitted from the LED head 42, a transfer part 44 that transfers the toner image formed by the toner image forming part 43 onto the sheet 12, and a fixing device 45 that fixes the toner image on the sheet 12.

Here, the toner image forming part 43, the transfer part 44 and the fixing device 45 are positioned so that the toner image forming part 43 and the transfer part 44 are positioned on the upstream side and that the fixing device 45 is positioned on the downstream side in a carrying direction of the sheet 12 fed from the sheet accommodation part 40. In addition, the toner image forming part 43 and the transfer part 44 are provided so as to face each other across a carrying path for the sheet 12. The LED head 42 is positioned above the toner image forming part 43.

In this configuration, when the print controller (not shown) receives a print instruction from a host device or the like, or when an instruction for printing is inputted from an input part of the device, a sheet 12 is fed from the sheet accommodation part 40 and is carried to the toner image forming part 43 by the sheet carrying part 41 at a timing for image formation.

The LED head 42 exposes the toner image forming part 43 in response to the print information to form an image as a latent image. The image formed on the toner image forming part 43 is formed to a toner image by a development device. The toner image is transferred onto the sheet 12 by the transfer part 44.

After that, the sheet 12 is carried to the fixing device 45 by the sheet carrying part 41. After the toner image is fixed onto the sheet 12 by the heat and pressure at the fixing device 45, the sheet 12 is carried by the sheet carrying part 41 and is ejected onto a stacker.

Next, the fixing device 45 shown in FIG. 1 is explained. The fixing device 45 includes a sheet heating body 1 that is as a heating body, a pressure application support member 2, a heat diffusion member 3, an endless fixing belt 4, a pressure application member 5 as a first pressure application member, a fixing roller 6 as a second pressure application member, a pressure application roller 7 that also carries the sheet 12, an elastic member 8 as a first biasing device, a support member 9, an elastic member 10 as a second biasing device, a support member 17, and a temperature detection device 18. Each member excluding the pressure application roller 7, that is, each of the sheet heating body 1, the pressure application support member 2, the heat diffusion member 3, the pressure application member 5, the fixing roller 6, the elastic member 8, the support member 9 and the elastic member 10, is arranged inside the fixing belt 4. The fixing belt 4 movably extends as being wound on the heat diffusion member 3, the pressure application member 5 and the fixing roller 6. Here, the sheet heating body 1, the pressure application support member 2, and the heat diffusion member 3 are collectively referred to as a fixing device heating unit. According to the known knowledge, various types of shapes or thicknesses might be applied to the sheet heating body 1 as long as the sheet heating body 1 functions to apply heat to a medium that is carried along the path.

The sheet heating body 1 is a device that heats up the fixing belt 4 and is attached to the pressure application support member 2. The heat diffusion member 3 is a device that diffuses and transfers the heat of the sheet heating body 1 to the fixing belt 4. The elastic member 8 is a device that applies load to the sheet heating body 1, the pressure application support member 2 and the heat diffusion member 3 and applies tension to the fixing belt 4. A coil spring and the like are used as the elastic member 8. The elastic member 8 is positioned between the pressure application support member 2 and the support member 9. The support member 9 is fixed relative to the main body device and supports the pressure application support member 2 and the sheet heating body 1 via the elastic member 8.

The pressure application roller 7 is provided to contact an outer circumferential surface of the fixing belt 4 at a position opposite from the heat diffusion member 3. The pressure application member 5 and the fixing roller 6 are arranged to be adjacent to, and face, each other. The pressure application member 5 and the fixing roller 6 are arranged to press the fixing belt 4 against the pressure application roller 7. Here, the elastic member 10 presses the pressure application member 5 against the pressure application roller 7 and is held by the support member 17 that is relatively fixed to the main body device. The contact part of the fixing belt 4 and the pressure application roller 7 forms a nip part. The sheet 12, on which the toner image by a toner 11 has been transferred, is fed into the nip part.

The temperature detection device 18 that abuts an inner circumferential surface of the fixing belt 4 is provided in the present fixing device 45. However, the temperature detection device 18 may abut the outer circumferential surface of the fixing belt 4. Alternatively, the temperature detection device 18 may be of a non-contact type in which the temperature detection device 18 is provided with a minute gap.

Figure 3:
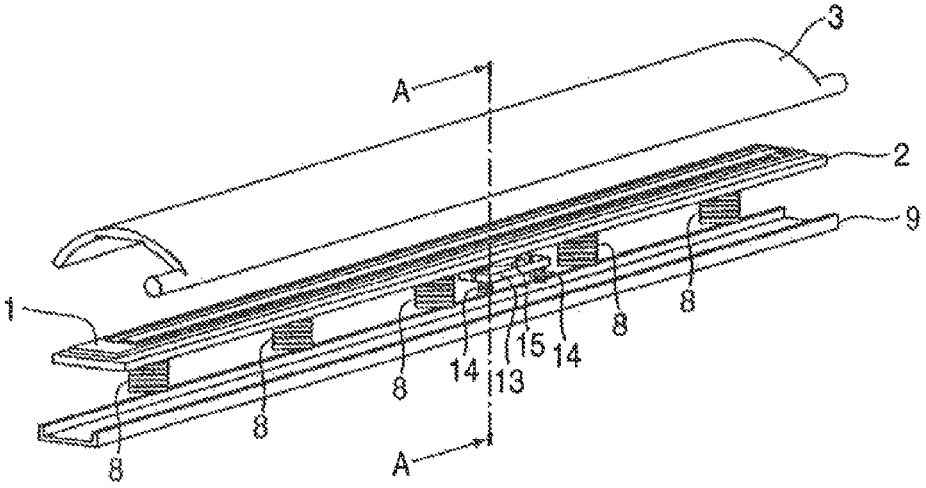
FIG. 3 is a perspective view of main members of the first embodiment.
Figure 4:
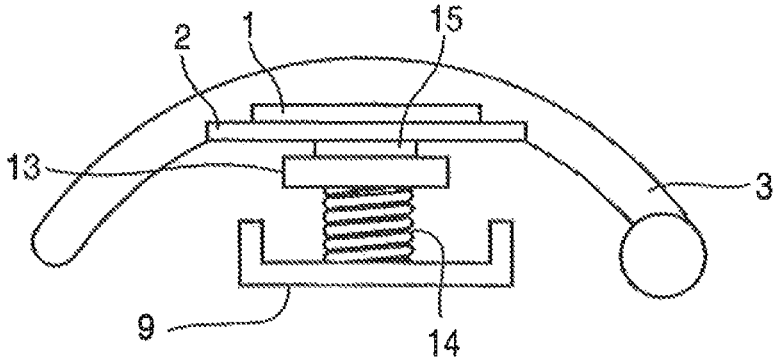
FIG. 4 is a cross-sectional view seen from a line A-A in FIG. 3.

FIG. 3 is a perspective view of main members of the fixing device 45. FIG. 4 is a cross-sectional view seen from a line A-A in FIG. 3, which illustrates a configuration of the sheet heating body 1, the pressure application support member 2, the heat diffusion member 3, the elastic member 8, the support member 9 and the like. As shown in FIG. 3, the sheet heating body 1, the pressure application support member 2, the heat diffusion member 3, and the support member 9 have similar predetermined lengths. A plurality of elastic members 8 are arranged between the pressure application support member 2 and the support member 9. A two-step indented part is formed on a lower surface (inner surface) of the heat diffusion member 3. The sheet heating body 1 fits in the deeper side (upper side) of the indented part to surface-contact the heat diffusion member 3. The pressure application support member 2 fits in the front side (lower side) of the indented part so that edges of the pressure application support member 2 contact the heat diffusion member 3.

In addition, an attachment member 13 is attached at a center part of the support member 9 via a plurality of elastic members 14. An overtemperature protector 15 is attached on the attachment member 13. The overtemperature protector 15 abuts the lower surface of the pressure application support member 2 by a biasing force of the elastic member 14.

The pressure application support member 2 is made of a metal with excellent heat conductivity and processability, such as aluminum, copper and the like; an alloy having such a metal as a main component; or an iron, iron-type alloys, stainless steel or the like with high heat durability and stiffness, and is formed in a plate form with uniform thickness. The pressure application support member 2 is not used in the conventional fixing device. The overtemperature protector 15 is a thermostat that detects a temperature and cuts off a power source that supplies electric power to the sheet heating body 1 when the detected temperature exceeds a certain temperature. In the present embodiment, the upper limit value of the operational temperature is 270° C.

Figure 17:
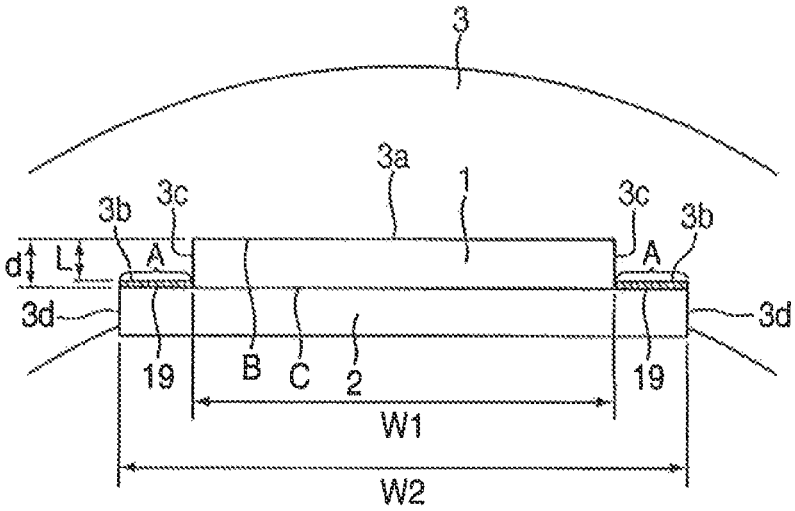
FIG. 17 is an enlarged view of main parts in FIG. 4.

FIG. 17 is an enlarged view of main parts in FIG. 4 and illustrates in detail a relationship between the sheet heating body 1, the pressure application support member 2 and the heat diffusion member 3. The indented part is formed on the heat diffusion member 3 for restricting the position of the sheet heating body 1. Restriction parts 3*c* that restrict the position of the sheet heating body 1 with respect to the moving direction of the fixing belt 4 are formed on the indented part. In addition, an abutting part 3*a* is formed on the indented part for restricting the position the sheet heating body 1 in a direction in which the elastic member 8 biases the sheet heating body 1 and thereby causing the sheet heating body 1 and the heat diffusion member 3 to abut each other. In addition, heat transfer parts 3*b* are formed on the indented part for transmitting the heat from the pressure application support member 2 to the heat diffusion member 3. Moreover, restriction parts 3*d* that restricts the position of the pressure application support member 2 with respect to the moving direction of the fixing belt 4 are formed on the indented part.

Here, the indented part is formed such that a relationship L<d is established, where L is a distance between the abutting part 3*a* and the heat transfer parts 3*d* in a direction in which the elastic member 8 biases the sheet heating body 1, and d is a thickness of the sheet heating body 1. With such a relationship, the sheet heating body 1 is securely contacted to the abutting part 3*a* of the heat diffusion member 3 by the biasing force of the elastic member 8 via the pressure application support member 2.

In addition, with L<d, a space is created between the pressure application support part 2 and the heat transfer part 3*b* to prevent the heat transfer between the pressure application support member 2 and the heat transfer part 3*b* from being blocked by the space, a surface area of the pressure application support member 2 is formed larger than a surface area of the sheet heating body 1 so as to form projection areas A. The projection areas A are areas by which the pressure application support member 2 project from the sheet heating body 1 on the surface where the pressure application support member 2 and the sheet heating body 1 abut each other. In addition, heat conductive grease 19 is applied in the projection areas A.

Specifically, as shown in FIG. 17, a relationship W1<W2 is established where W1 is a width of the sheet heating body 1 in a direction approximately perpendicular to the longitudinal direction of the sheet heating body 1, and W2 is a width of the pressure application support member 2 in a direction approximately perpendicular to the longitudinal direction of the pressure application support member 2. The sheet heating body 1 and the pressure application support member 2 abut each other within the width W2 of the pressure application support member 2 while the projection areas A and the heat transfer parts 3*b* respectively face each other. The heat conductive grease 19 is applied to the pressure application support member 2 to fill up the space between the heat transfer part 3*b* and the pressure application support member 2. In addition, as shown in FIG. 3, the width of the sheet heating body 1 in its longitudinal direction and the width of the pressure application support member 2 in its longitudinal direction satisfy similar relationships.

For the heat conductive grease 19, silicon oil is used as base oil, and zinc oxide is added for improving heat conductivity. By doing so, the heat is efficiently conducted between the pressure application support member 2 and the heat diffusion member 3. Therefore, the heat is balanced between the pressure application support member 2 and the heat diffusion member 3, and thus, the heat is transferred such that the temperature of the pressure application support member 2 becomes close to the temperature of the heat diffusion member 3. As a result, the temperature of the pressure application support member 2 is not unnecessarily increased, thereby reducing unnecessary increase in the temperature of the overtemperature protector 15. Moreover, an effect to transfer heat to the heat diffusion member 3 from a back surface C of the sheet heating body 1, which has been transferred to the pressure application support member 2 side, is obtained. Therefore, the heat at the sheet heating body 1 is efficiently transferred to the heat diffusion member 3, and thereby, an effect of reducing the time for the fixing belt 4 to reach to a target temperature is obtained.

Figure 5:
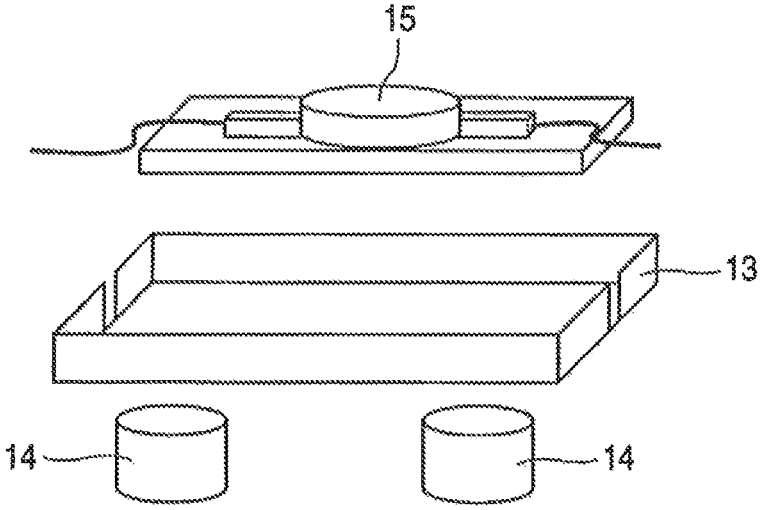
FIG. 5 is a perspective view of a mounting configuration of an overtemperature protector.

FIG. 5 is a perspective view of a mounting configuration of the overtemperature protector 15. The overtemperature protector 15 is attached to and wired on the attachment member 13. End parts of the attachment member 13 are supported by elastic members 14. The overtemperature protector 15 abuts the lower surface of the pressure application support member 2 with a constant load by a biasing force of the elastic member 14.

Figure 6A:
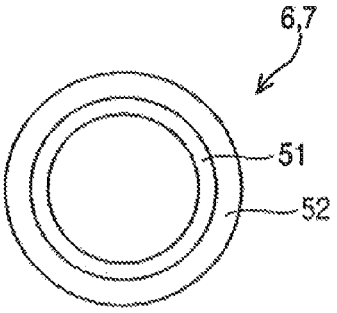
FIGS. 6A and 6B are side views of a configuration of a fixing roller and a pressure application roller.
Figure 6B:
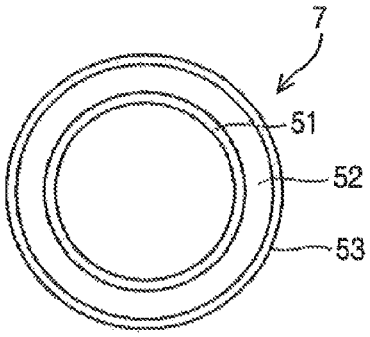

FIGS. 6A and 6B are side views of a configuration of the fixing roller 6 and the pressure application roller 7. As shown in FIG. 6A, the fixing roller 6 and the pressure application roller 7 are configured from a cored bar 51 and an elastic layer 52 that covers a surface of the cored bar 51. Here, for the cored bar 51, a pipe or shaft of a metal, such as aluminum, iron, stainless steel and the like is used for securing certain stiffness. For the elastic layer 52, rubber with high heat resistance, such as normal silicon rubber, spongy silicon rubber, fluororubber and the like, is used. Moreover, as shown in FIG. 6B, the pressure application roller 7 may be configured to form a release layer 53 on the elastic layer 52 that covers the surface of the cored bar 51.

A gear (not shown) is provided on an end of the fixing roller 6. As the gear is driven by the rotational force transmitted from the sheet carrying part 41, the fixing roller 6 rotates. The rotational force of the fixing roller 6 is transmitted to the fixing belt 4 and the pressure application roller 7 by the frictional force. As a result, the fixing belt 4 and the pressure application roller 7 respectively follow and rotate in the arrow direction in FIG. 1. The pressure application roller 7 may be rotated and driven by the rotational force from the sheet carrying part 41.

Moreover, the fixing roller 6 is biased by an elastic member (not shown), such as a spring and the like, so as to press the pressure application roller 7 via the fixing belt 4. The pressure application member 5 is biased by an elastic member 8, such as a coil spring shown in FIG. 1 and the like, so as to press the pressure application roller 7 via the fixing belt 4. As a result, a nip part in the area where the pressure application member 5 and the pressure application roller 7 abut each other via the fixing belt 4, and a nip part in the area where the fixing roller 6 and the pressure application roller 7 abut each other via the fixing belt 4 are continuously formed to configure a single nip part.

Figure 7:
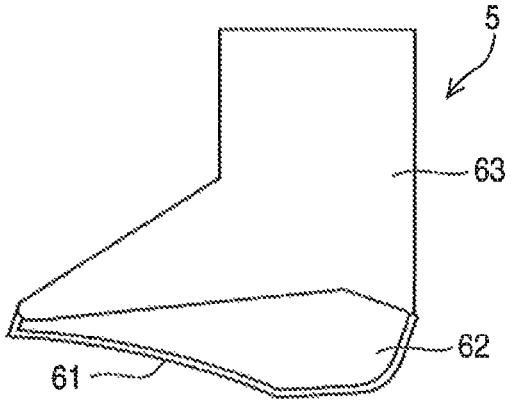
FIG. 7 is a side view of a configuration of a pressure application member.

FIG. 7 is a side view of a configuration of the pressure application member 5. As shown in the figure, the pressure application member 5 is configured from a surface layer 61, an elastic layer 62 and a base material 63. For the surface layer 61, a resin material with high heat resistance and low surface frictional resistance, such as a normal silicon type resin or fluorine-based resin and the like, is used. The elastic layer 62 is a layer provided between the surface layer 61 and the base material 63. Similar to the elastic layer 52, a rubber material with high heat resistance, such as normal silicon rubber, spongy silicon rubber or fluororesin and the like, is used. Moreover, for the base material 63, a metal material, such as aluminum, iron, stainless steel and the like, is used to maintain certain stiffness. The pressure application member 5 with such a configuration forms a region with a certain pressure distribution, as the pressure application member 5 is pressed towards the side of the fixing belt 4 and the pressure application roller 7 by the elastic member 8, such as a coil spring as shown in FIG. 1 and the like.

Figure 8A:
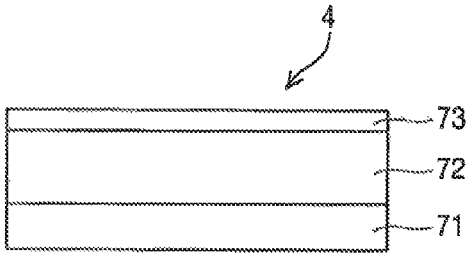
FIGS. 8A and 8B are partial side views of a configuration of a fixing belt.
Figure 8B:
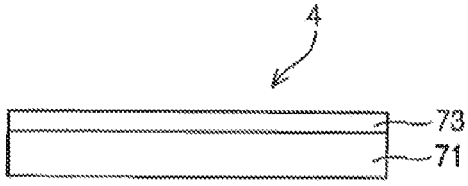

FIGS. 8A and 8B are partial side views of a configuration of the fixing belt 4. The fixing belt 4 is formed by forming a thin layer of an elastic layer 72 on a thin base 71 as shown in FIG. 8A. A release layer 73 may be provided on the elastic layer 72.

If the base 71 is made of nickel, polyimide, stainless steel or the like, a thickness of the base 71 is preferably approximately 30 μm to 150 μm to achieve both strength and flexibility.

For the elastic layer 72, silicon rubber or fluororubber that has high heat resistance is used. If silicon rubber is used, a thickness of the elastic layer 72 is preferably 50 μm to 300 μm to achieve both low hardness and high heat conductivity. If fluororesin is used, the thickness of the elastic layer 72 is preferably 10 μm to 50 μm to achieve both durability against reduction of body due to friction and high heat conductivity.

For the release layer 73, a resin with high heat resistance like the elastic layer 72 and low surface free energy after formation, for example, a representative or fluorine-based resin, such as polytetrafluoroethylene (PTFE), perfluoroalkoxy alkane (PFA), perfluoroethylene-propene copolymer (FEP) and the like, is used. A thickness of the release layer 73 is preferably 10 μm to 50 μm.

In addition, the fixing belt 4 may be provided with the release layer 73 on the thin base 71 as shown in FIG. 8B.

The fixing belt 4 with such a configuration is stretched as being wound on the heat diffusion member 3, the pressure application member 5 and the fixing roller 6 with the elastic layer 72 or the release layer 73 facing outside.

Figure 9A:
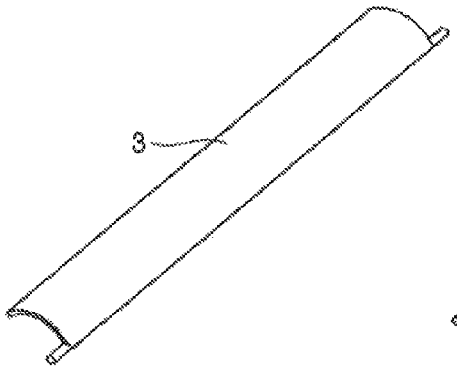
FIGS. 9A and 9B are perspective views of a heat diffusion member.
Figure 9B:
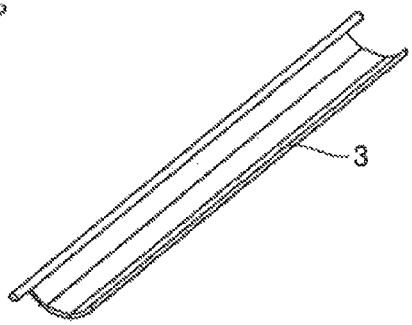

FIGS. 9A and 9B are perspective views of the heat diffusion member 3. FIG. 9A shows an upper surface side, and FIG. 9B shows a lower surface side. The heat diffusion member 3 in the present embodiment has an arc cross-sectional shape, and the above-described indented part is formed on the lower surface side through the entire length of the heat diffusion member 3 in the longitudinal direction. The entire body of the heat diffusion member 3 is formed by a metal with high heat conductivity and excellent processability, such as aluminum, copper and the like; an alloy with such materials as main components; iron, iron-type alloys or stainless steel with high heat resistance and high stiffness; or the like. The heat diffusion member 3 and the sheet heating body 1 are made integral without any particular adhesion, as the heat diffusion member 3 is pressed against the sheet heating body 1 by the biasing force of the elastic member 8.

Figure 10:
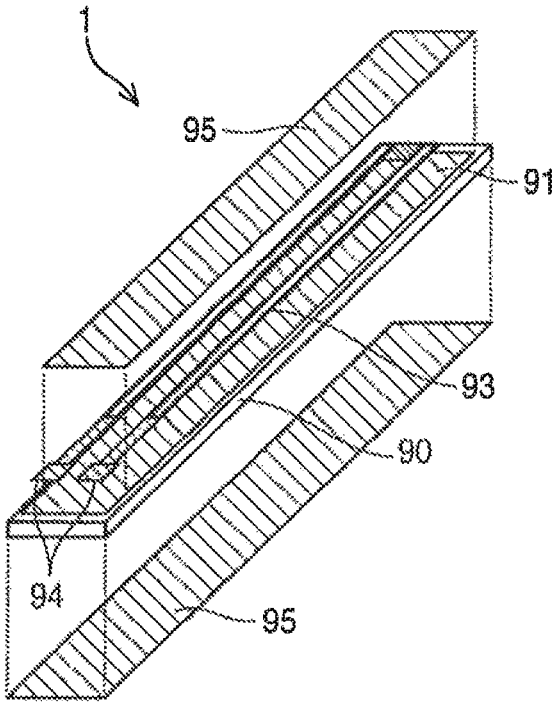
FIG. 10 is an exploded perspective view of a sheet heating body.

FIG. 10 is an exploded perspective view of the sheet heating body 1. For the sheet heating body 1, a ceramic heater, a stainless heater or the like is used. Explaining in further details, with regard to the sheet heating body 1, in case of the stainless heater, an electric insulation layer 91 using a thin glass film is formed on a substrate 90, such as SUS430, and a resistance heating body 93 is formed by applying a nickel chrome alloy or a silver-palladium allow powder in a paste form using screen printing. At an end of the resistance heating body 93, electrodes 94 are formed with a chemically stable metal with low electric resistance or a metal with a high melting point such as tungsten and the like. A protective film 95 made of glass or a representative fluorine-based resin, such as polytetrafluoroethylene (PTFE), perfluoroalkoxy alkane (PFA), perfluoroethylene-propene copolymer (FEP) and the like, is formed on the resistance heating body 93. The protective film 95 protects the electric insulation layer 91, the resistance heating body 93 and the electrodes 94. The protective film 95 may be provided on the lower surface of the substrate 90.

Operation of the above-described configuration is explained. In FIG. 1, the fixing belt 4 travels as the fixing belt 4 is rotated and driven by the fixing roller 6 in the arrow direction while the fixing belt 4 slides on the heat diffusion member 3. As electric power is supplied to the sheet heating body 1, a contact part is heated. The surface of the fixing belt 4 is maintained at a proper temperature by detecting the surface (back surface) temperature of the fixing belt 4 using the temperature detection device 18 and by controlling the electric power supplied to the sheet heating body 1 based on the detected temperature using the controller (not shown). To prevent overtemperature of the sheet heating body 1 at this time, the overtemperature protector 15 abuts the pressure application support member 2 as shown in FIG. 4.

The sheet 12, on which the toner 11, that is, the toner image, has been transferred, is carried through the nip part formed at a press-contact part between the fixing belt 4 and the pressure application roller 7. At that time, as the toner 11 and the sheet 12 are heated by the fixing belt 4, and as the pressure application member 5 and the fixing roller 6 respectively applies pressure onto the pressure application roller 7, the toner image is fixed to the sheet 12.

In addition, the pressure application support member 2 is regulated in the above description by a range of the thickness. Where C2 is a heat capacity of the pressure application support member 2, a range of the heat capacity C2 is preferably configured in a range of 11.75 J/K or greater and 24.2 J/K or less. Moreover, where C1 is a heat capacity of the heat diffusion member 3, the heat capacity C2 is preferably configured at 30% or greater and 62% or less of the heat capacity C1.

As shown in FIG. 17, the sheet heating body 1 includes a front surface B and the back surface C. The front surface B is a surface that configures the sheet heating body 1 on the side that the resistance heating body 93 is provided, and the back surface C is a surface on the opposite side from the front surface B and a surface that configures the sheet heating body 1. Here, the front surface B is configured to abut the heat diffusion member 3, and the back surface C is configured to abut the pressure application support member 2. This is because the heat increases faster on the front surface B on which the resistance heating body 93 than the back surface C. As a result, there is an effect to fasten temperature increase of the heat diffusion member 3 as much as possible and to delay the heat transfer to the pressure application support member 2. Because the heat transfers from high to low, a chance that the temperature of the overtemperature protector 15 is increased is reduced by causing the temperature of the pressure application support member 2 to increase faster.

Figure 11:
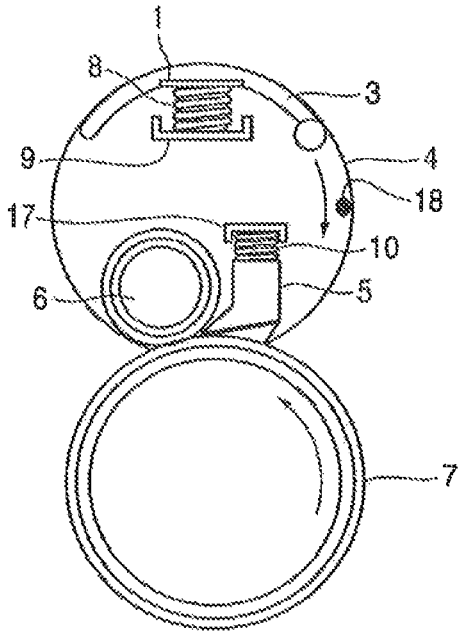
FIG. 11 is a side view of a reference fixing device illustrated for comparison with the first embodiment.

FIG. 11 is a side view of the fixing device (hereinafter referred to as a reference fixing device) illustrated for comparison with the first embodiment. The reference fixing device is configured similarly to the fixing device 45 of the first embodiment shown in FIG. 1 with exceptions that the pressure application support member 2 is removed from the fixing device 45 of the first embodiment, and that the overtemperature protector 15 directly abuts the sheet heating body 1.

Figure 12:
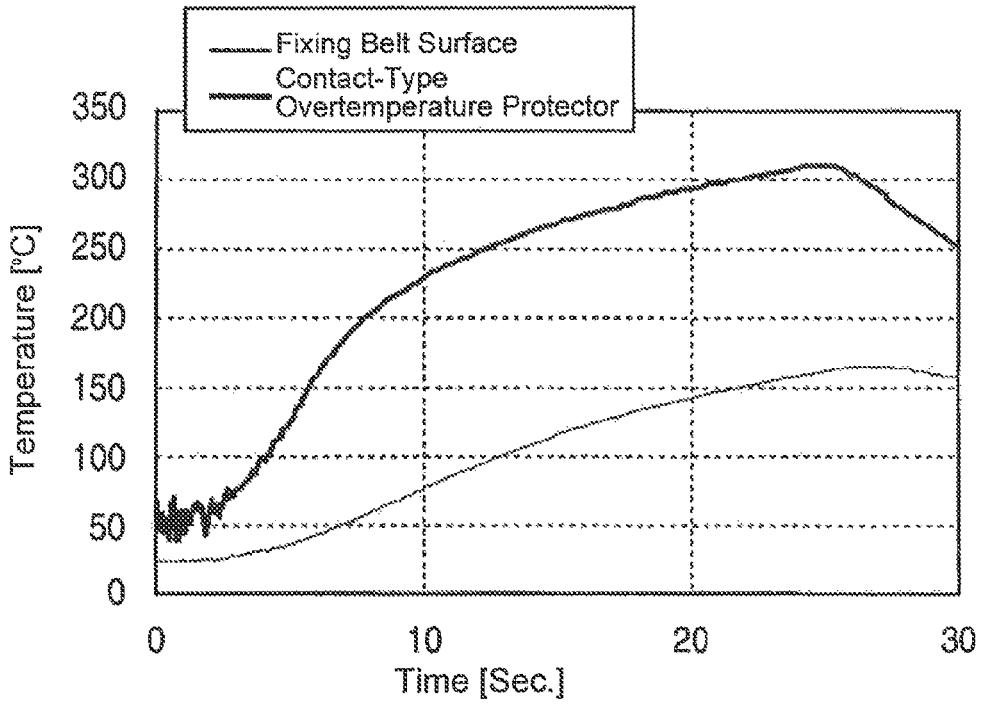
FIG. 12 illustrates a temperature history in the reference fixing device.

FIG. 12 illustrates a temperature history in the reference fixing device, which shows starting time and temperatures measured at a contact part of the contact-type overtemperature protector 15 under the below indicated conditions. Here, the starting time is the time from a start of supply of electric power to the sheet heating body 1 to when the surface temperature of the fixing belt 4 reaches a target fixing temperature of 160° C.

[Evaluation Conditions]

fixing belt 4: Inner diameter being 45 mm; the base being of polyimide and having a thickness of 80 μm; elastic layer being silicon rubber and having a thickness of 150 μm; and releasing layer being of PFA and having a thickness of 30 μm Peripheral velocity of fixing belt 4: 60 mm/s fixing roller 6: ϕ=16, cored bar having C hardness of 80 degrees measured by ASKER; elastic layer being spongy silicon rubber and having a thickness of 1.5 mm Pressure application roller 7: (ϕ=36; cored bar having C hardness of 80 degrees measured by ASKER; elastic layer being spongy silicon rubber and having a thickness of 1.2 mm Pressure application member 5: Base material being a metal material, such as aluminum; elastic layer being silicon rubber having JIS-A hardness of 20 degrees and a thickness of 1 mm Pressure application force of pressure application member 5: 35 kg Sheet heating body 1: Stainless heater; width being 12 mm; 1200 W Heat diffusion member 3: Aluminum plate having thickness of 1 mm; heat capacity C1=39.1 J/K Nip part: Width (length) being 13 mm As understood from FIG. 12, the starting time of the reference fixing device from the room temperature is approximately 24 seconds. At this time, the temperature of the overtemperature protector 15 that abuts the sheet heating body 1 reached about 310° C. due to overshoot. In general, the operational upper limit temperature of the overtemperature protector 15 is 27° C. Therefore, the overtemperature protector 15 cannot be used while contacting the sheet heating body 1 under the configuration of the reference fixing device.

The fixing device 45 of the present embodiment has a configuration in which the pressure application support member 2 is placed between the sheet heating body 1 and the overtemperature protector 15. The overtemperature protector 15 abuts the lower surface of the pressure application support member 2 by the biasing force of the elastic member 14. An evaluation was conducted to obtain usage conditions for the fixing device 45 of the present embodiment including the above-described configuration.

[Evaluation Conditions]

Pressure application support member 2: Aluminum plate with width of 16 mm, length of 326 mm, and thickness of 1 mm (heat capacity C2*a*=11.7 J/K), 1.5 mm (heat capacity C2*b*=18 J/K) and 2 mm (heat capacity C2*b*=24.2 J/K) (three types)

Other evaluation conditions are the same as the case of the reference fixing device.

Figure 13:
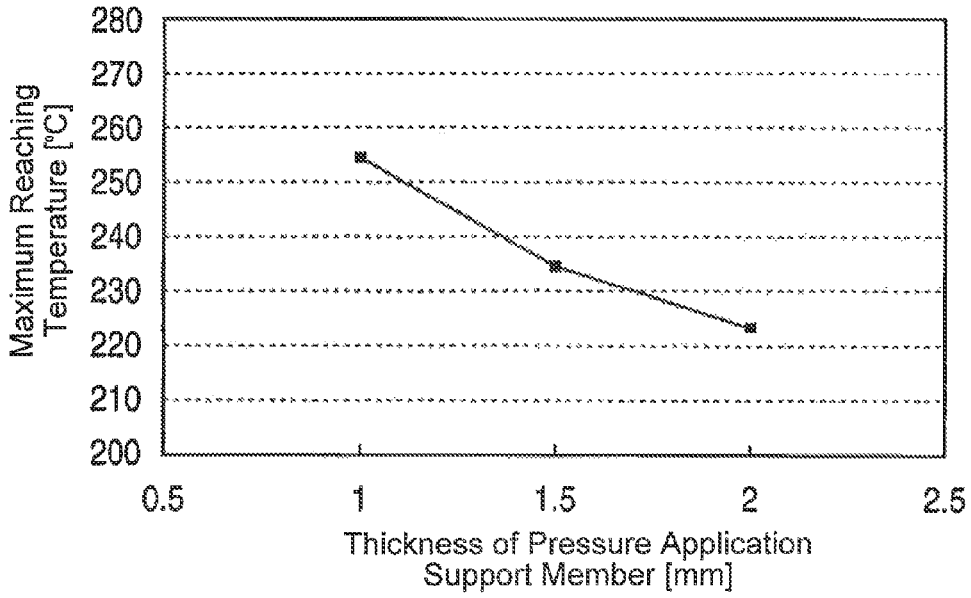
FIG. 13 illustrates maximum reaching temperatures of the overtemperature protector.
Figure 14:
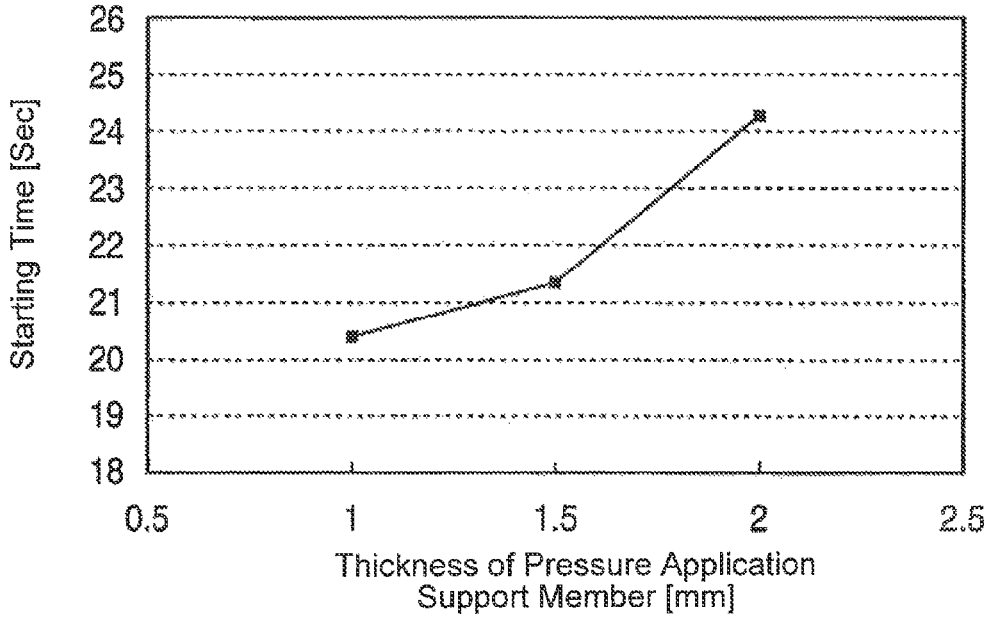
FIG. 14 illustrates starting time of the overtemperature protector.

Similar to the reference fixing device, for the fixing device 45 of the present embodiment, the temperature history for the starting time from the room temperature was measured using the three types of the pressure application support member 2 with different thicknesses. FIG. 13 illustrates respective maximum reaching temperatures of the overtemperature protector 15 using the three types of the pressure application support member 2 at the time when the temperature of the fixing belt 4 detected by the temperature detection device 18 reaches the target temperature (160° C.). FIG. 14 illustrates starting time of the overtemperature protector 15.

As shown in FIG. 13, as the thickness of the pressure application support member 2 increases, the heat capacity increases. Accordingly, the temperature at a location where the overtemperature protector 15 abuts is reduced. Here, considering the operational upper limit temperature of the overtemperature protector 15 and margins, the thickness of the pressure application support member 2 is preferably equal to or greater than 1 mm.

However, as the thickness of the pressure application support member 2 increases, the heat capacity increases. Accordingly, the starting time increases. Nonetheless, in the case where the thickness of the pressure application support member 2 is 2 mm, the starting time was 24.3 seconds, which did not show a significant delay compared with the reference fixing device.

This is assumed that, although the heat capacity increases by the amount of the pressure application support member 2 in the fixing device 45 of the present embodiment, the temperature of the pressure application support member 2 heated by the sheet heating body 1 increases faster than the temperature of the heat diffusion member 3, and a heat transfer occurs from the pressure application support member 2 and the heat diffusion member 3 at that time, resulting in an increase of the heat capacity applied to the fixing belt 4. Therefore, the contact between the pressure application support member 2 and the heat diffusion member 3 contributes to an effect of reducing the starting time. Accordingly, the thickness of the pressure application support member 2 is equal to or less than 2 mm to achieve the same condition as the starting time for the reference fixing device.

Based on the above results, the thickness of the pressure application support member 2 is equal to or greater than 1 mm and equal to or less than 2 mm to use the overtemperature protector 15 and the pressure application support member 2 by abutting each other while securing the starting time with the reference fixing device.

Excellent effects are obtained by satisfying:

$$T2\max \geq (C1 \times T1\max)/(C2 \times \alpha) \quad (1)$$

where C1 is the heat capacity of the heat diffusion member 3, C2 is the heat capacity of the pressure application support member 2, T1max is the maximum reaching temperature of the fixing belt 4, and T2max is the maximum reaching temperature of the overtemperature protector 15.

Here, the value α is a coefficient. In the present embodiment, with the maximum reaching temperature T1max of the fixing belt 4 being 164° C. (T1max=164° C.), the maximum reaching temperature T2max being 255° C. (T2max=255° C.), and the heat capacity C1 being 39.1 J/K (C1=39.1 J/K) as fixed design values, the heat capacity C2 is adjusted by changing the thickness of the pressure application support member 2 by 0.5 mm. The thickness of the pressure application support member 2, with which T2max exceeded 270° C., is 0.5 mm. Therefore, with the thickness of the pressure application support member 2 being 1.0 mm (heat capacity C2=11.7) as a boarder value, the value a that corresponds to the boarder value is calculated by plugging the above-described design values in the below equation.

$$T2\max \geq (C1 \times T1\max)/(C2 \times \alpha)$$

$\alpha$=2.14

By plugging α in Equation (1), Equation (2) is obtained.

$$T2\max \geq (C1 \times T1\max)/(C2 \times 2.14) \quad (2)$$

As shown in the present embodiment, with the configuration in which the sheet heating body 1 is pressed against the heat diffusion member 3 by the pressure application support member 2, and in which the overtemperature protector 15 abuts the opposite side of the pressure application support member 2 from the abutting surface of the pressure application support member 2 abutting the sheet heating body 1, the temperature of the fixing belt 4 reaches a predetermined temperature before the maximum reaching temperature of the overtemperature protector 15 reaches a predetermined value, by setting the components to satisfy Equation (2).

As explained above, according to the present embodiment, a chance that the temperature the overtemperature protector 15 unnecessarily increases is reduced by providing the pressure application support member 2 between the sheet heating body 1 and the overtemperature protector 15. In addition, by configuring the thickness of the pressure application support member 2 in a range equal to or greater than 1 mm and equal to or less than 2 mm, the overtemperature protector 15 is maintained within a range of the operational upper limit temperature while securing predetermined starting time.

Second Embodiment

Figure 15:
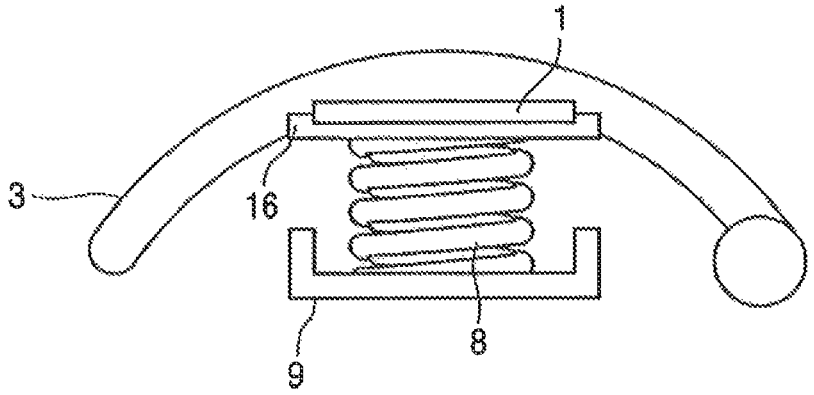
FIG. 15 is a side view of main members of a second embodiment of the present invention.

FIG. 15 is a side view of main members of a second embodiment of the present invention. In the second embodiment, instead of the pressure application support member 2 in the first embodiment, a pressure application support member 16 is used. Similar to the pressure application support member 2, the pressure application support member 16 is made of a metal with excellent heat conductivity and processability, such as aluminum, copper and the like; an alloy having such a metal as a main component; or an iron, iron-type alloys, stainless steel or the like with high heat durability and stiffness.

In the present embodiment, the sheet heating body 1 and the pressure application support member 16 provided on an inner surface of the heat diffusion member 3 are pressed against the heat diffusion member 3 at certain load applied by the elastic member 8 fixed on the support member 9 and stretches the fixing belt 4 with the heat diffusion member 3.

Other parts are similar to the above-described first embodiment.

The pressure application support member 16, together with the sheet heating body 1, is pressed by a plurality of elastic members 14 using coil springs. Therefore, there is a risk of deformation, such as warping and the like, due to twisting by an external force and/or heat. When the pressure application support member 16 is deformed, the contact state between the sheet heating body 1, the pressure application support member 16 and the heat diffusion member 3 in the longitudinal direction changes. As a result, the temperature of the heat diffusion member 3 becomes uneven in the longitudinal direction, and as such, the surface temperature of the fixing belt 4 that contacts the toner 11 and the sheet 12 and fixes the toner image by the toner 11 onto the sheet 12 as shown in FIG. 1 also becomes uneven. This phenomenon eventually causes generation of uneven gloss on the toner image.

Figure 16:
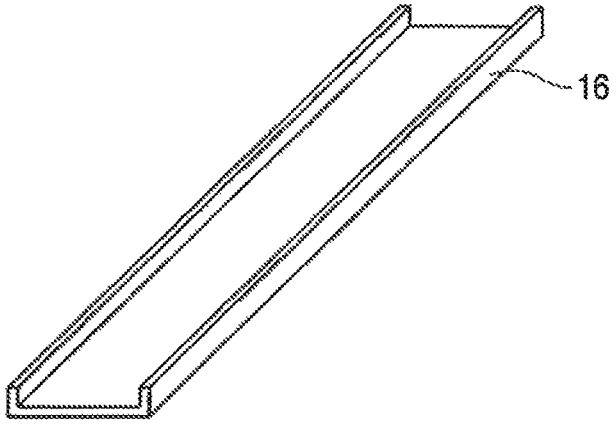
FIG. 16 is a perspective view of a pressure application support member in the second embodiment.

Therefore, in the present second embodiment, the pressure application support member 16 is configured to have the shape shown in FIG. 16. FIG. 16 is a perspective view of the pressure application support member 16 in the second embodiment. As shown in FIG. 16, to prevent the pressure application support member 16 from being deformed by the external force or warped due to heat, front and back edge parts of the plate-shape pressure application support member 16 with a constant thickness are folded in the same direction (upward direction) to form a U shape. By placing the sheet heating body 1 inside the pressure application support member 16 formed in the U shape, the folded edge parts of the pressure application support member 16 are inserted into the indented part of the heat diffusion member 3 and contact the heat diffusion member 3.

In addition, in the present embodiment, to secure the starting time and the range of use of the overtemperature protector 15, the heat capacity of the pressure application support member 16 is configured in a range of 12.5 J/K or more and 25 J/K or less.

According to the second embodiment, in addition to the advantages similar to those in the first embodiment, the heat conduction is made uniform in the longitudinal direction because the deformation by the external force and warping due to heat are prevented by forming the pressure application support member 16 in the U shape. Moreover, because of this, the uneven surface temperature of the fixing belt 4 is prevented. Therefore, there is an advantage that the fixing of the toner image without uneven gloss is achieved. In the above-described embodiments, the fixing device is explained that is installed in an electrographic printer as an image forming device. However, the above embodiments are also applicable in the multifunction peripheral (MPF), facsimile machines, photocopy machines and the like.

What is claimed is:

1. A fixing device, comprising:
an endless belt that supplies heat to a medium;
a heat diffusion member that stretches the endless belt;
a heating body that heats the heat diffusion member;
an overtemperature protector that is positioned to face the heating body; and
a support member that is positioned between the heating body and the overtemperature protector.

2. The fixing device according to claim 1, wherein
the heat diffusion member includes an indented part that abuts the heating body; and
the indented part includes
an abutting part that abuts the heating body, and
a heat transfer part that faces the support member.

3. The fixing device according to claim 2, wherein
the heating body is configured with a sheet heating body that is in a sheet shape,
a surface area of the support member is formed larger than a surface area of the sheet heating body, and
areas of the support member that project from the sheet heating body face the heat transfer part.

4. The fixing device according to claim 2, wherein
the heating body is configured with a sheet heating body that is in a sheet shape,
a distance between the abutting part and the heat transfer part is smaller than a thickness of the sheet heating body.

5. The fixing device according to claim 2, further comprising:
heat conductive grease that is applied between the heat transfer part and the support member.

6. The fixing device according to claim 1, wherein
the support member is an aluminum plate having a heat capacity of 11.75 J/K or more and 24.2 J/K or less.

7. The fixing device according to claim 1, wherein
the support member is a copper plate.

8. The fixing device according to claim 1, wherein
the support member is a plate having a uniform thickness.

9. The fixing device according to claim 1, wherein
the support member is formed in a U shape by folding edge parts of a plate of the support member.

10. The fixing device according to claim 1, wherein
the support member is positioned in contacting edge parts to the heat diffusion member.

11. The fixing device according to claim 1, wherein
the overtemperature protector is positioned in abutting the support member.

12. The fixing device according to claim 1, wherein a heat capacity of the support member is 30% or more and 62% or less of a heat capacity of the heat diffusion member.

13. The fixing device according to claim 1, wherein a thickness of the support member is 1 mm or more and 2 mm.

14. The fixing device according to claim 1, wherein an expression below is satisfied:

$$T2\max \geq (C1 \times T1\max)/(C2 \times \alpha)$$

where C1 is a heat capacity of the heat diffusion member, C2 is a heat capacity of the support member, T1max is a maximum reaching temperature of the endless belt, T2max is a maximum reaching temperature of the overtemperature protector, and $\alpha$ is a coefficient.

15. An image forming apparatus, comprising:

the fixing device according to claim 1.

16. A fixing device heating unit, comprising:

a heat diffusion member that diffuses heat including a two-step indented part, the two-step indented part including a first indented section and a second indented section larger than the first indented section;

a heating body that heats the heat diffusion member and that has a first width, the heating body being fitted in the first indented section and including a first side facing the heat diffusion member and a resistance heating body being provided on the first side;

a support member that contacts the heating body and has a second width larger than the first width, the support member being fitted in the second indented section; and heat transfer from the heating body to the heat diffusion member is faster than from the heating body to the support member.

* * * * *